US009073194B2

(12) United States Patent
Herelier et al.

(10) Patent No.: US 9,073,194 B2
(45) Date of Patent: Jul. 7, 2015

(54) PLUG GUIDE FOR A NAILING DEVICE AND A DEVICE COMPRISING THE PLUG GUIDE

(75) Inventors: Patrick Herelier, Saint Jean de Muzols (FR); Guy Jaillet, La Roche de Glun (FR)

(73) Assignee: SOCIETE DE PROSPECTION ET D'INVENTIONS TECHNIQUES SPIT, Bourg les Valence (FR)

( * ) Notice: Subject to any disclaimer, the term of this patent is extended or adjusted under 35 U.S.C. 154(b) by 401 days.

(21) Appl. No.: 13/155,030

(22) Filed: Jun. 7, 2011

(65) Prior Publication Data

US 2011/0297727 A1 Dec. 8, 2011

(30) Foreign Application Priority Data

Jun. 8, 2010 (FR) ..... 10 02417

(51) Int. Cl.
*B25C 5/00* (2006.01)
*B25C 1/18* (2006.01)

(52) U.S. Cl.
CPC ..... *B25C 1/188* (2013.01)

(58) Field of Classification Search
CPC ..... B25C 1/188; B25C 1/08; B25C 1/082; B25C 7/00
USPC ..... 227/10–11, 139
See application file for complete search history.

(56) References Cited

U.S. PATENT DOCUMENTS 3,407,982 A * 10/1968 Henning ..... 227/9
3,895,752 A * 7/1975 Hatayama et al. ..... 227/10
4,883,211 A 11/1989 Philipp et al.
5,904,284 A * 5/1999 Lin ..... 227/11
6,286,742 B1 * 9/2001 Mukoyama ..... 227/8
2004/0226976 A1 * 11/2004 Towfighi et al. ..... 227/10
2006/0011693 A1 * 1/2006 Wywialowski et al. ..... 227/109
2009/0289094 A1 11/2009 Shiestl et al.

FOREIGN PATENT DOCUMENTS

CH 683679 A5 4/1994
CN 2542408 Y 4/2003
CN 201423622 Y 3/2010
DE 66148 A5 3/1969
DE 1603890 A1 2/1971
DE 7423833 U 6/1976
DE 3806831 A1 9/1989

(Continued)

OTHER PUBLICATIONS

French Search Report for French Patent Application No. 1002417 dated Feb. 10, 2011.

(Continued)

*Primary Examiner* — Andrew M Tecco
(74) *Attorney, Agent, or Firm* — Lowe Hauptman & Ham LLP

(57) ABSTRACT

The plug guide comprises a bore for receiving a nail comprising a head and a shaft onto which a skirt is slid, the bore having a passing section determined so that the head and the skirt of the nail cause it to be guided therein, a recess being provided in the front part of the plug guide for ejecting and expanding the guiding skirt. The recess comprises at least one radial bulge projecting inside, for extending the wall of the bore of the plug guide and forming a narrowing for guiding the nail. This invention further relates to a fastening device comprising the plug guide.

16 Claims, 3 Drawing Sheets

(56) References Cited

FOREIGN PATENT DOCUMENTS

| | | | | | |
|---|---|---|---|---|---|
| DE | 10306880 | B4 | | 9/2004 | |
| EP | 2127816 | A2 | | 12/2009 | |
| GB | 1167643 | A | * | 10/1969 | ..... B25C 1/18 |

OTHER PUBLICATIONS

German Office Action dated Jan. 10, 2012 corresponding to German Patent Application No. 10 2011 075 817.8.

* cited by examiner

PLUG GUIDE FOR A NAILING DEVICE AND A DEVICE COMPRISING THE PLUG GUIDE

RELATED APPLICATIONS

The present application is based on, and claims priority from, French Application Number 1002417 filed Jun. 8, 2010, the disclosure of which is hereby incorporated by reference herein in its entirety.

The field of this invention is that of nailing devices for fastening nails in a supporting material. These are devices allowing nails to be driven by means of a driving piston, being in turn propelled by an electric, pneumatic or thermal motor.

Today, such devices are most often devices with internal combustion engine, with a combustible gas.

Such devices have, at the front, what is referred to as a muzzle-bushing—in fact a plug guide—that should be in abutment against the supporting material for being able to actuate them. This is the so-called abutment safety. But, such a plug guide also has the function of guiding nails up to the supporting material.

For being properly guided in the gun of the devices as well as in the plug guide, nails are guided in two axially separated areas, the first, at the level of the head thereof, having the same diameter as the bore (of the gun) and of the plug guide, the second, at the level of a guiding skirt slid around the stem thereof and in abutment against the wall of the bore.

In order to better implement the ejection and the expansion of the skirt of the nails going out of the devices, it has been suggested to recess the front end of the plug guides.

But for solving such a problem, another one has been created. With such a recessed structure, the head of nails is no longer guided on the very last portion of the stroke thereof, just before the supporting material, when it opens out in the recess of the plug guide. This is damaging to the fastening safety.

The invention of the present application aims at globally overcoming this latter problem without, on the other hand, giving up solving the first one.

Thus, this invention relates to a plug guide of a nailing device, comprising a bore for receiving a nail comprising a head and a shaft onto which a skirt is slid, the bore having a passing section determined so that the head and the skirt of the nail cause it to be guided therein, a recess being provided in the front part of the plug guide for ejecting and expanding the guiding skirt, said plug guide being characterized in that the recess comprises a narrowing with the same passing section as the receiving bore, whereby the nails remain guided in the bore of the plug guide until they go out of it.

The narrowing is advantageously formed by at least two radial bulges being diametrically opposed when there are only two, at 120° one relative to the others when they are three.

This invention further relates to a nailing device comprising a plug guide, such as claimed-herein above.

This invention will become more obvious reading the following description of the plug guide and of the fastening device of this invention, referring to the appended drawing, in which.

Figure 1:
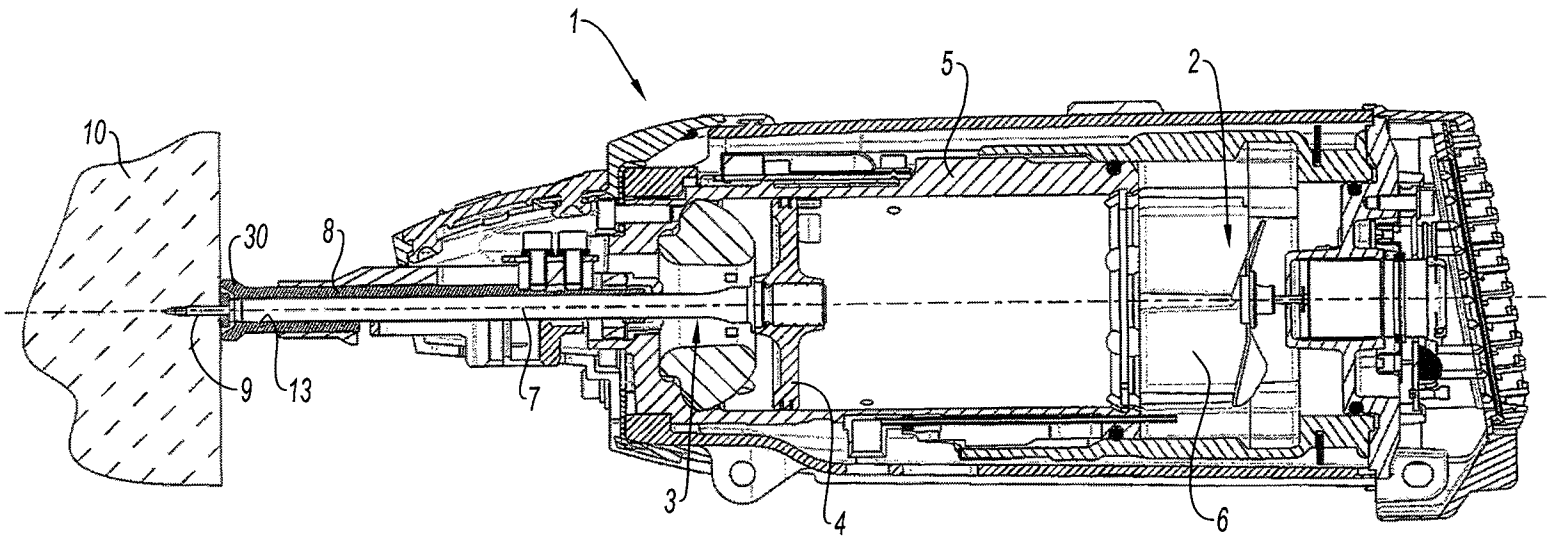
Fig. 1 PRIOR ART
FIG. 1 shows an axial sectional view of a nailing device provided with a prior art plug guide, upon a shot, the nail being almost at the stroke end.

Referring to FIG. 1, a prior art nailing device 1, here with an internal combustion engine 2, comprises a driving piston 3, with a head 4 able to be moved into a cylinder 5 under the action of the ignition of the fuel in the chamber 6 of the device.

The piston shaft 7, at the end of the shot, is engaged in the plug guide 8 after having propelled the nail 9 into the supporting material 10 adapted to receive it. The nail 9 comprises a head 11 and a shaft 12. The head 11 has a diameter substantially equal to that of the bore 13 of the plug guide 8.

A guiding skirt 14 is arranged on the shaft 12 of the nail. While the nail is shifted in the plug guide 8, the skirt comes in abutment against the wall of the bore 13 so as to guide the nail. In the front part 30 of the plug guide 8, there is provided a frustoconical recess 15 for ejecting and expanding the skirt 14. Such a front part is flared towards the front.

Figure 2:
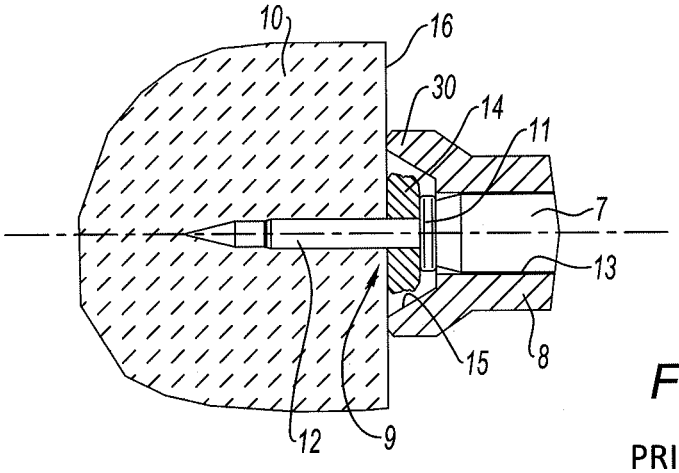
Fig. 2 PRIOR ART
FIG. 2 shows an enlarged view of the front part of the plug guide in the device of FIG. 1.

In the position of FIGS. 1 and 2, the nail 9 is not completely driven yet in the material 10. The guiding skirt 14 has gone out of the part of the plug guide 8 with a section corresponding to that of the nail head 11. The skirt 14 was able to expand before the head 11 of the nail crushes it against the supporting material and that is thus able to be ejected when the operator will get the device out of abutment against the material 10. In the position of FIG. 2, the nail head has just gone out of the bore 13, with a determined and constant section and, between such a position and the complete driving of the nail, until the head 11 comes against the surface 16 of the material 10, the nail is no longer guided.

Figure 3:
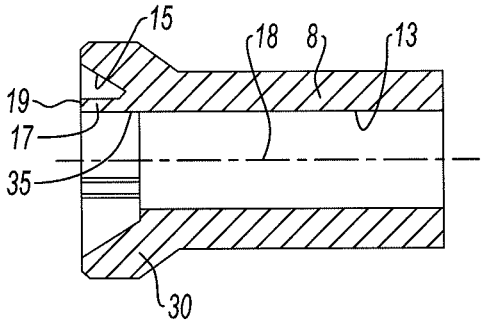
FIG. 3 is a very large scale sectional view of the front part of a plug guide of this invention.
Figure 4:
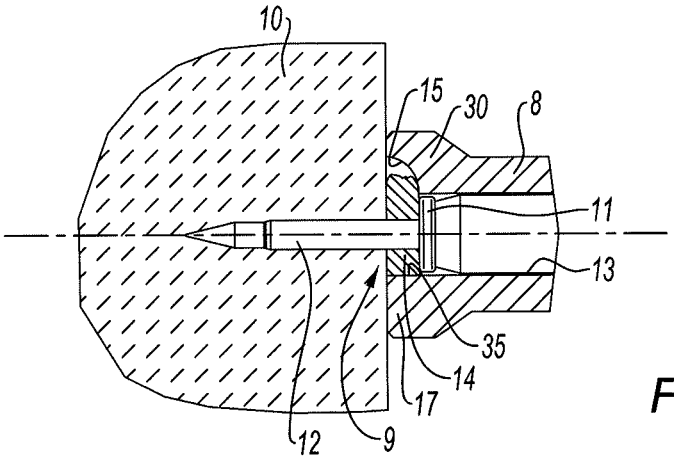
FIG. 4 is a sectional view of the front part of the plug guide of FIG. 3, upon a shot, the nail being almost at the stroke end.

Referring to FIG. 3, where identical references show the same means as on FIGS. 1 and 2, there can be seen in the sectional plane being considered a radial narrowing bulge 17 of the wall of the recess 15 projecting inside, towards the axis 18 of the plug guide, for extending the wall of the bore 13 of the plug guide, extending behind the recess 15, up to the front end 19 of the plug guide 8. Although this is not the case in practice, even if there is only this one radial bulge 17 and at least this one, the nail head 9 would still, during its stroke through the recess 15 and along such a partial narrowing 35, be guided at least partially, both at the level of the head 11 thereof as at the level of the guiding skirt 14 thereof, as can be seen on FIG. 4.

In practice, the recess 15 actually comprises a narrowing 40 with the same passing section as the bore 13 for receiving the nail and in fact comprises several radial bulges.

Figure 5:
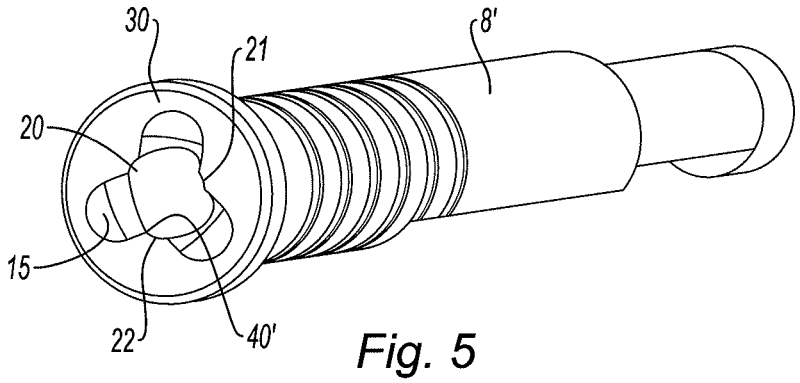
FIG. 5 is a perspective view of the plug guide of this invention, in an embodiment with three narrowing bulges.

As far as the plug guide 8' of FIG. 5 is concerned, the narrowing 40' is formed by three radial bulges 20-22 angularly spaced apart, two by two by 120°.

Figure 6:
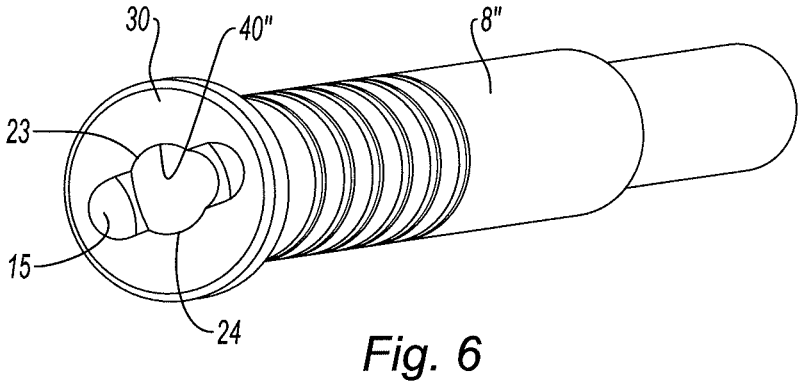
FIG. 6 is a perspective view of the plug guide of this invention, in an embodiment with two narrowing bulges.

On the plug guide 8" of FIG. 6, the narrowing 40" is formed by only two diametrically opposed radial bulges 23, 24.

There could be more of them, but not too many, so that the recess 15 for expanding and ejecting the guiding skirt of nails remains.

The invention claimed is:

1. A device, comprising:

plug guide of a nailing device for fastening nails, comprising:

a first section configured to receive a nail having a head, a stem connected to the head and a skirt arrayed about the stem, wherein the first section is configured to guide the skirt therein; and a second section provided at a front of the plug guide, downstream of the first section, relative to a direction movement of the fastening nails during nailing, configured to enable expansion of the skirt, wherein a first interior diameter, of the first section, lying on a first plane passing through the first section is less than that of a second diameter, of the second section, proximate the first diameter and lying on a second plane passing through the second section, the first and second interior diameters lying on a third plane normal to the first and second planes, the first and second planes being normal to a longitudinal axis of the first section, a first portion of the first section establishing one side of the first interior diameter being configured to guide the skirt during operation of the nailing device to fasten nails, and a second portion of the second section establishing one side of the second interior diameter also being configured to guide the skirt during operation of the nailing device to fasten nails, wherein relative to the longitudinal axis, a center of the first diameter lying on the third plane is offset from a center of the second diameter also lying on the third plane, and at least one of:

the first section has a circular cross-section lying on the first plane, the first diameter corresponding to the diameter of the circular cross-section and a diameter of the skirt when the skirt is bisected by the first plane;

the first section and the second section are contiguous with one another, a boundary between the first section and the second section lying on a plane normal to the longitudinal axis and at a location where the second portion of the second section first deviates from the first portion of the first section relative to the direction of movement of the fastening nails during nailing; or relative to the third plane, the second section is wider than the first section at all locations.

2. The plug guide according to claim 1, wherein:

the second section includes a sidewall having a cross-section lying on the third plane that extends at an oblique angle relative to a section of a sidewall of the first section also lying on the third plane.

3. The plug guide according to claim 1, wherein:

the second section includes a guide surface that is contiguous with and parallel to a sidewall of the first section, wherein the guide surface is part of the second portion.

4. The plug guide according to claim 1, wherein:

the second section includes three guide surfaces, separate from one another, that are contiguous with and parallel to a sidewall of the first section, the three guide surfaces respectively being surfaces of respective protrusions, the respective protrusions extending, relative to the longitudinal axis, away from the first section in the second section.

5. The plug guide, according to claim 1, wherein the second section includes three radial bulges that protrude into the second section away from the first section, the direction of protrusion being in a radial direction relative to the direction of extension of the first section.

6. The plug guide, according to claim 1, wherein the second section includes two radial bulges that protrude into the second section away from the first section, respective directions of protrusions being in a radial direction relative to the direction of extension of the first section.

7. An apparatus, comprising:

a nailing device for fastening nails, including the plug guide of claim 1, wherein the device includes a piston shaft configured to drive the nail, wherein the piston shaft is configured to reciprocate inside the first section, and relative to the first plane, an area established by an outer cross-section, lying on the first plane, of the piston shaft substantially equaling an area established by the inner cross-section, also lying on the first plane, of the first section.

8. An apparatus, comprising:

a nailing device for fastening nails, including the plug guide of claim 1, and the nail having a head, a stem connected to the head and a skirt arrayed about the stem, wherein the skirt is located in the first section, and has a circular outer cross-section lying on the first plane, the head of the nail being separated by a distance from all surfaces of the first and second sections.

9. An apparatus, comprising:

a nailing device for fastening nails, including the plug guide of claim 1, and the nail having a head, a stem connected to the head and a skirt arrayed about the stem, wherein the skirt is located in the second section, and has a non-circular outer cross-section lying on the second plane.

10. The device of claim 1, wherein the first and second sections are immediately proximate one another.

11. The device of claim 1, wherein, relative to the third plane, the second section is wider than the first section.

12. A device, comprising:

plug guide of a nailing device for fastening nails, comprising:

a first section configured to receive a nail having a head, a stem connected to the head and a skirt arrayed about the stem, wherein the first section is configured to guide the skirt therein; and a second section provided at a front of the plug guide downstream from the first section and configured to enable expansion of the skirt, wherein the second section is configured to resist expansion of the skirt more in a first direction than in a second direction, the first and second directions lying on a plane normal to a longitudinal axis of the first section, the second section being configured to resist the expansion by allowing the skirt to expand uninhibitedly in the first direction due to a space between the skirt and a surface of the second section, the space being bisected by the plane.

13. The device of claim 12, wherein the first section has a circular cross section lying on a plane normal to the longitudinal axis of the first section.

14. The device of claim 12, wherein the first and second sections are configured to provide respective channels through which the skirt travels, wherein with respect to a plane lying on a longitudinal axis of the first section, a geometric center of the second channel extends away from that of the first channel to establish the space between the skirt and the surface of the second plane bisected by the plane.

15. The device of claim 12, wherein the first and second sections are configured to provide respective channels through which the skirt travels, wherein with respect to a plane lying on a longitudinal axis of the first section, the second channel widens more on one side than on the other side to establish the space between the skirt and the surface of the second plane bisected by the plane.

16. An apparatus, comprising:

a nailing device for fastening nails, including the device of claim 12, and the nail having a head, a stem connected to the head and a skirt arrayed about the stem, wherein the skirt is located in the first section, and has a circular outer cross-section lying on the first plane, the head of the nail being separated by a distance from all surfaces of the first and second sections.

* * * * *